US010619374B1

(12) United States Patent
Wong

(10) Patent No.: US 10,619,374 B1
(45) Date of Patent: Apr. 14, 2020

(54) FOUNDATIONLESS POLE APPARATUS

(71) Applicant: Thomas K. Wong, San Francisco, CA (US)

(72) Inventor: Thomas K. Wong, San Francisco, CA (US)

( * ) Notice: Subject to any disclaimer, the term of this patent is extended or adjusted under 35 U.S.C. 154(b) by 0 days.

(21) Appl. No.: 16/174,700

(22) Filed: Oct. 30, 2018

(51) Int. Cl.

| | |
|---|---|
| ***E04H 12/22*** | (2006.01) |
| ***E04H 12/18*** | (2006.01) |
| *G09F 17/00* | (2006.01) |
| *E04H 12/34* | (2006.01) |

(52) U.S. Cl.
CPC ..... *E04H 12/2261* (2013.01); *E04H 12/187* (2013.01); *E04H 12/2238* (2013.01); *E04H 12/2284* (2013.01); *E04H 12/345* (2013.01); *G09F 17/00* (2013.01)

(58) Field of Classification Search
CPC . E04H 12/2261; E04H 12/345; E04H 12/187; E04H 12/2284; E04H 12/18; E04H 12/2269; E04H 12/2238; E04H 12/34; E04H 12/2276; E04H 12/2292; E04H 12/20; E04H 12/2253; E04H 12/22; E04H 12/2246
See application file for complete search history.

(56) References Cited

U.S. PATENT DOCUMENTS

| | | | | |
|---|---|---|---|---|
| 639,286 | A | | 12/1899 | Prevost |
| 2,792,948 | A | | 5/1957 | De Shano |
| 3,112,037 | A | | 11/1963 | Thiermann |
| 3,190,465 | A | | 6/1965 | Newman |
| 3,236,398 | A | | 2/1966 | Thiermann |
| 3,267,627 | A | | 8/1966 | Hammitt |
| 3,315,976 | A | | 4/1967 | Thiermann |
| 3,680,448 | A | | 8/1972 | Ballingall et al. |
| 3,792,980 | A | | 2/1974 | Vollmer et al. |
| 3,820,906 | A | | 6/1974 | Katt |
| 3,895,471 | A | | 7/1975 | Kolb |
| 3,941,083 | A | | 3/1976 | Morse et al. |
| 4,079,559 | A | | 3/1978 | Tenbrummeler |
| 4,114,766 | A | | 9/1978 | Decker et al. |
| 4,311,324 | A | | 1/1982 | Fries |
| 4,362,451 | A | | 12/1982 | Thiermann, Sr. |
| 4,492,496 | A | | 1/1985 | Arnold |
| 4,823,870 | A | * | 4/1989 | Sorokan ..... E21B 15/003 166/79.1 |
| 4,926,592 | A | | 5/1990 | Nehls |
| 5,058,336 | A | | 10/1991 | Jenvey |
| 5,248,157 | A | | 8/1993 | Rice |
| 5,476,352 | A | | 12/1995 | Culbertson et al. |
| 5,560,588 | A | * | 10/1996 | Hilliard ..... E04G 21/3223 256/59 |
| 5,634,759 | A | | 6/1997 | Jenvey |
| 5,782,040 | A | | 7/1998 | McCartan |
| 5,794,378 | A | | 8/1998 | Beatrez |
| 5,899,651 | A | | 5/1999 | Jenvey |
| 5,927,925 | A | | 7/1999 | Winkelmann |
| 6,191,355 | B1 | | 2/2001 | Edelstein |

(Continued)

*Primary Examiner* — Ryan D Kwiecinski
*Assistant Examiner* — Matthew J Gitlin
(74) *Attorney, Agent, or Firm* — Thomas R. Lampe

(57) ABSTRACT

A foundationless pole apparatus including an elongated pole shaft, a wheeled rolling weight box, a pole base connected to the pole shaft and securement structure securing the rolling weight box with the front wheels of the rolling weight box on the base to the pole base and the pole shaft.

8 Claims, 8 Drawing Sheets

(56) References Cited

U.S. PATENT DOCUMENTS

| | | | | |
|---|---|---|---|---|
| 6,216,414 | B1 | 4/2001 | Feldberg | |
| 6,264,162 | B1 | 7/2001 | Barnes et al. | |
| 6,322,038 | B1 | 11/2001 | Ghahremani | |
| 6,390,436 | B2 | 5/2002 | Barnes et al. | |
| 6,399,881 | B2 | 6/2002 | Edelstein | |
| 6,428,242 | B1 | 8/2002 | Ward | |
| D463,250 | S * | 9/2002 | Valentz | D8/349 |
| 6,709,215 | B1 | 3/2004 | Sorensen | |
| 6,851,231 | B2 | 2/2005 | Tadros et al. | |
| 6,955,025 | B2 | 10/2005 | Dehlsen et al. | |
| 7,267,516 | B1 | 9/2007 | Sorensen | |
| 7,275,351 | B2 | 10/2007 | Knepp | |
| 7,866,927 | B1 | 1/2011 | Wong | |
| 8,317,226 | B1 | 11/2012 | Wong | |
| 8,555,563 | B1 * | 10/2013 | Wong | A01G 17/14 52/117 |
| 2015/0189988 | A1 * | 7/2015 | Saich | F24F 13/32 211/182 |
| 2015/0308140 | A1 * | 10/2015 | Clifton | F03D 9/007 248/346.2 |
| 2018/0202123 | A1 * | 7/2018 | Spronken | E02D 27/42 |

* cited by examiner

FOUNDATIONLESS POLE APPARATUS

TECHNICAL FIELD

This invention relates to a pole installation apparatus and more particularly to a pole apparatus which can be installed and utilized without use of separate foundations or pole anchors. The pole apparatus incorporates a combination of unique structural elements and cooperative relationships which are operable to resist tilting of the pole due to wind impact on the pole in forward, backward and sideway directions without requiring attachment to separate foundations or pole anchors.

BACKGROUND OF THE INVENTION

A typical pole such as a flagpole or light pole has a small footprint as its ground embedded foundation is small. However, these poles are not easily movable because of their foundation requirements. Wong U.S. Pat. No. 8,317,226, issued Nov. 27, 2012, discloses a foundationless pole installation system that enables a pole to be installed and relocated easily and quickly. It offers significant advantages in certain applications such as in temporary surveillance where quick installation and relocation of a pole is important. The disclosed approach in the patent uses a wider than typical base at the bottom of the pole to provide stability to prevent the center of gravity of the pole from falling beyond its base (a toppling over condition). However, a significant disadvantage of the foundationless pole system is its relatively large footprint. While the footprint size is normally not a problem, in a tight site such as a congested urban construction site, the sizable footprint requirement makes the system less desirable.

It is known to utilize a fixed heavy concrete base for attaching a metal pole on top of it to mount cameras. Equipment is housed inside the heavy concrete base to further increase its weight. This approach lowers the center of gravity of the pole system relative to its base to prevent it from toppling over. The obvious down side to this alternate approach is the heavy weight required. Weight lifting equipment is needed to install or relocate the pole system.

Mobility and ease of installation are both important and desirable. However, these two attributes are not normally compatible with security and stability. For example, one can install a camera pole on a wheeled platform or a lightweight platform for mobility or ease of installation. The problem is the lack of security or stability. A thief or other unauthorized individual can simply wheel or carry the unit away, not to mention the risks of toppling over. For practical use, a pole requires a certain height to be effective for mounting its payload. Safety and risk of toppling over are always a serious concern of any taller poles. The situation is even more acute if the "payload" is a solar panel or a large sign, which draws a large wind force. The challenge to create a pole system that is easy to install, to move, to relocate, to avoid theft, to resist heavy wind load, and with a small footprint is truly daunting.

U.S. Pat. No. 8,317,226 addresses some of the difficulties described above, but not the relatively large footprint problem.

Utilizing the invention disclosed herein, the footprint area can be reduced very substantially so that use at congested tight sites is possible.

Reducing the pole base substantially, say to a quarter of its footprint area would not solve the problem. This approach will only work if the wind load on the pole is minimal. For many practical applications where wind load is a serious consideration, this simplistic approach does not work. When the base of a foundationless pole is drastically reduced, the pull out force on the anchors holding down the pole will increase substantially, requiring concrete foundation for the anchor bolts or very long earth anchor screws, resulting in a big jump in installation difficulty. In addition, when very deep anchors are required at tight sites, the pole placement locations will be greatly restricted in order to avoid underground utility lines. The known prior art approach of adding fixed weight to the pole creates a different form of difficulty in terms of weight lifting equipment being required.

The subject invention uses a rolling weight box and integrates it to a foundationless pole that has a small footprint in an innovative manner. No weight lifting equipment is required. This new system overcomes all the challenges listed above.

The following prior art is believed to be representative of the current state of the prior art in this field: U.S. Pat. No. 8,317,226, issued Nov. 27, 2012, U.S. Pat. No. 639,286, issued Dec. 19, 1899, U.S. Pat. No. 2,792,948, issued May 21, 1957, U.S. Pat. No. 3,112,037, issued Nov. 26, 1963, U.S. Pat. No. 3,190,465, issued Jun. 22, 1965, U.S. Pat. No. 3,236,398, issued Feb. 22, 1966, U.S. Pat. No. 3,267,627, issued Aug. 23, 1966, U.S. Pat. No. 3,315,976, issued Apr. 25, 1967, U.S. Pat. No. 3,680,448, issued Aug. 1, 1972, U.S. Pat. No. 3,792,980, issued Feb. 19, 1974, U.S. Pat. No. 3,820,906, issued Jun. 28, 1974, U.S. Pat. No. 3,895,471, issued Jul. 22, 1975, U.S. Pat. No. 3,941,083, issued Mar. 2, 1976, U.S. Pat. No. 4,079,559, issued Mar. 21, 1978, U.S. Pat. No. 4,114,766, issued Sep. 19, 1978, U.S. Pat. No. 4,311,324, issued Jan. 19, 1982, U.S. Pat. No. 4,362,451, issued Dec. 7, 1982, U.S. Pat. No. 4,492,496, issued Jan. 8, 1985, U.S. Pat. No. 4,926,592, issued May 22, 1990, U.S. Pat. No. 5,058,336, issued Oct. 22, 1991, U.S. Pat. No. 5,248,157, issued Sep. 28, 1993, U.S. Pat. No. 5,476,352, issued Dec. 19, 1995, U.S. Pat. No. 5,634,759, issued Jun. 3, 1997, U.S. Pat. No. 5,782,040, issued Jul. 21, 1998, U.S. Pat. No. 5,794,378, issued Aug. 18, 1998, U.S. Pat. No. 5,899,651, issued May 4, 1999, U.S. Pat. No. 5,927,925, issued Jul. 27, 1999, U.S. Pat. No. 6,191,355, issued Feb. 20, 2001, U.S. Pat. No. 6,216,414, issued Apr. 17, 2001, U.S. Pat. No. 6,264,162, issued Jul. 24, 2001, U.S. Pat. No. 6,322,038, issued Nov. 27, 2001, U.S. Pat. No. 6,390,436, issued May 21, 2002, U.S. Pat. No. 6,399,881, issued Jun. 4, 2002, U.S. Pat. No. 6,428,242, issued Aug. 6, 2002, U.S. Pat. No. 6,709,215, issued Mar. 23, 2004, U.S. Pat. No. 6,851,231, issued Feb. 8, 2005, U.S. Pat. No. 6,955,025, issued Oct. 18, 2005, U.S. Pat. No. 7,267,516, issued Sep. 11, 2007, U.S. Pat. No. 7,275,351, issued Oct. 2, 2007 and U.S. Pat. No. 7,866,927, issued Jan. 11, 2011.

BRIEF SUMMARY OF THE INVENTION

The present invention relates to a foundationless pole apparatus including an elongated pole having a pole shaft.

A pole base is connected to the pole shaft and having pole base sides including a substantially straight pole base side spaced from said pole shaft and a pole base top support surface extending from said substantially straight pole base side toward said pole shaft.

A wheeled rolling weight box having wheels is positionable on said pole base top support surface.

A securement structure is operatively associated with the pole shaft, the pole base and the wheeled rolling weight box for securing said wheeled rolling weight box to said pole base and to said pole shaft with at least some of the wheels of said wheeled rolling weight box on said pole base top support surface and secured adjacent to said pole shaft.

Other features, advantages and objects of the present invention will become apparent with reference to the following description and accompanying drawings.

DETAILED DESCRIPTION OF THE INVENTION

Figure 1:
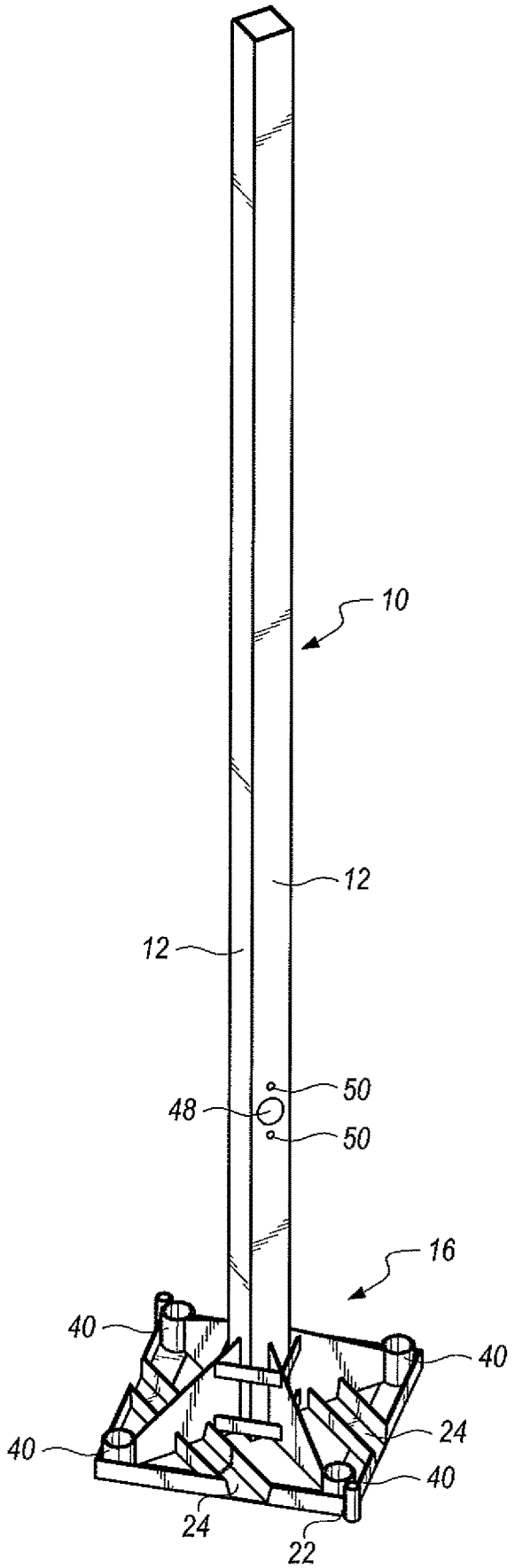
FIG. 1 is a perspective view of foundationless pole apparatus constructed in accordance with the teachings of the present invention.
Figure 2:
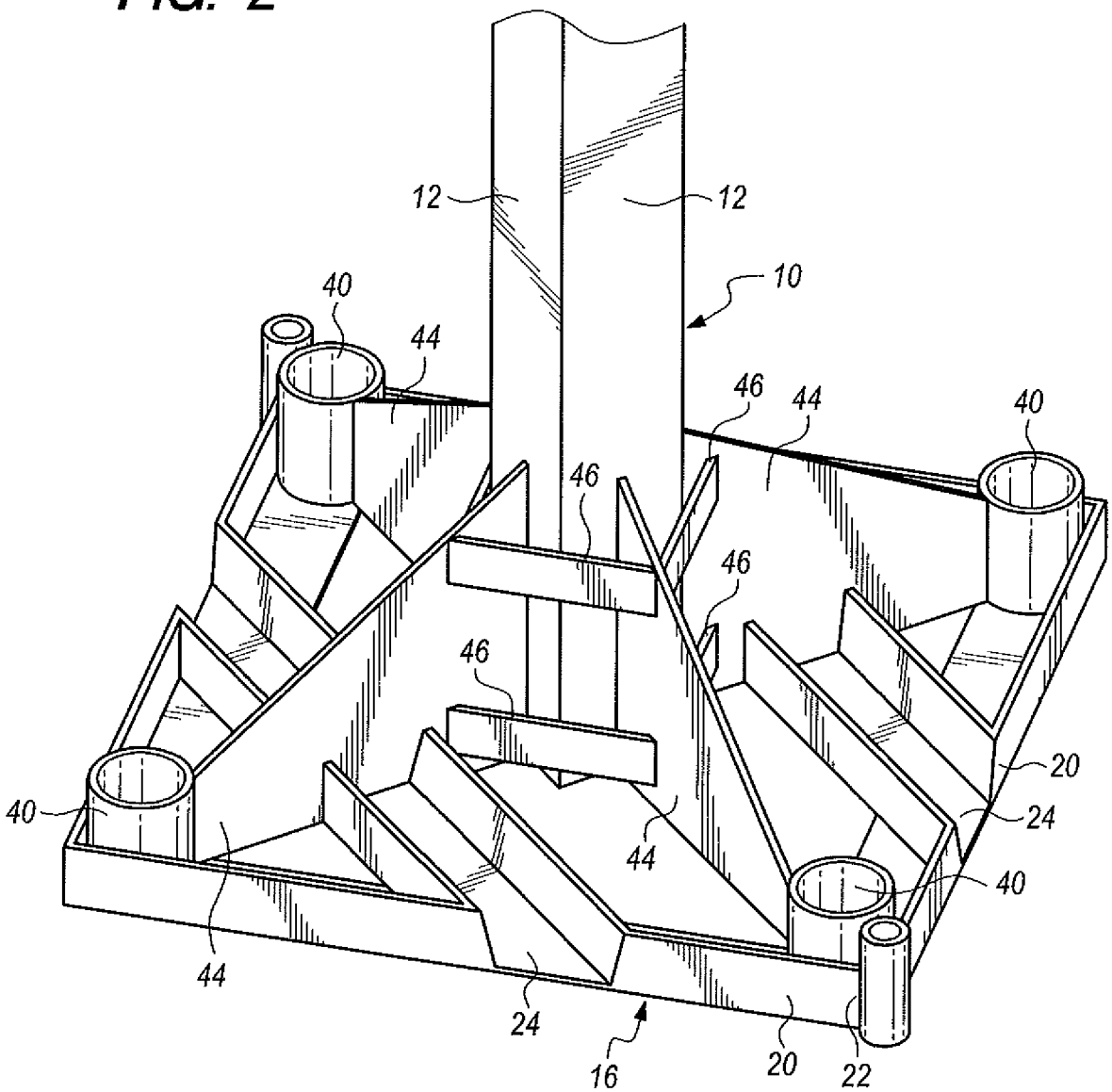
FIG. 2 is a enlarged, top perspective view showing the pole base of the foundationless pole apparatus and a portion of a square pole shaft of the elongated pole attached to the pole base.
Figure 3:
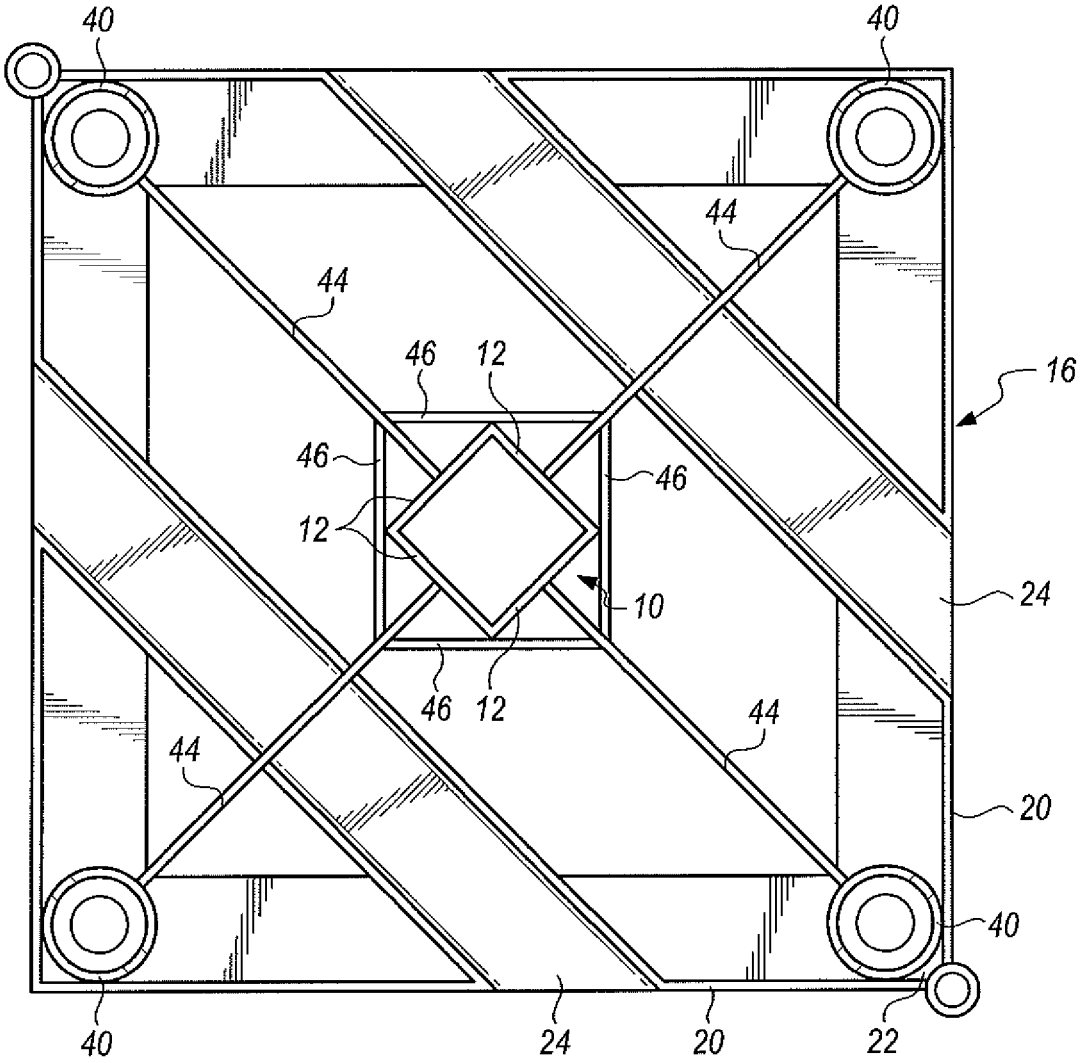
FIG. 3 is an enlarged, top plan view of the pole base.
Figure 4:
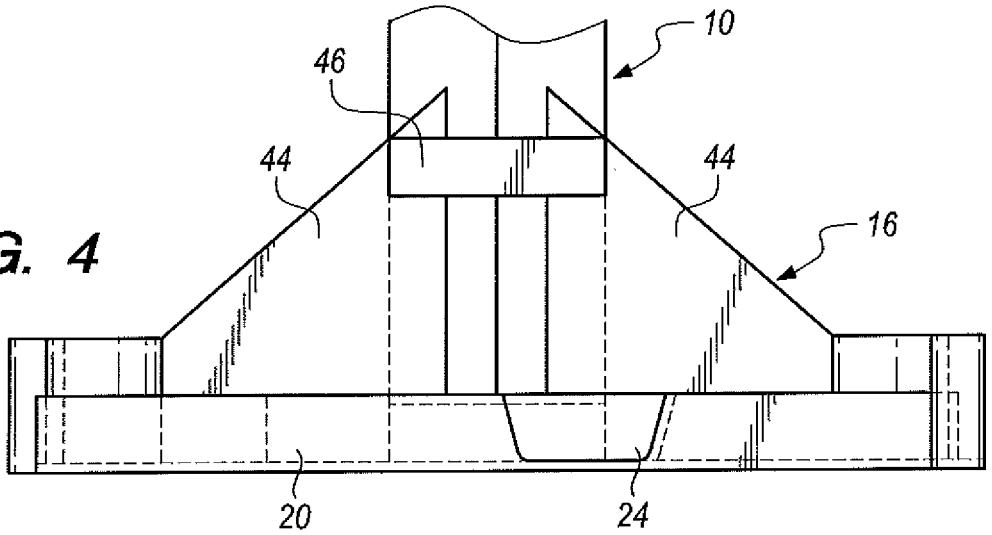
FIG. 4 is an enlarged, elevational view of the pole base and a portion of the square pole shaft of the elongated pole.

Referring now to FIGS. 1-8 of the drawings, a preferred embodiment of foundationless pole apparatus of the present invention includes an elongated pole having a square pole shaft 10 with four interconnected straight pole shaft sides 12.

The apparatus includes a pole base 16 attached to and supporting the square pole shaft 10. The pole base is square, being formed by four base sides which are disposed at right angles to one another. Two of the base sides are designated in the drawings by reference numeral 20 and form a pole base corner 22 comprising the base front.

The square pole shaft is oriented with the straight pole shaft sides 12 thereof disposed at 45 degree angles relative to the pole base sides 20.

The square pole shaft 10 provides for easy docking with a wheeled rolling weight box 30 which will be described in more detail below. The pole shaft is disposed at 45 degree rotation relative to the pole base. The pole base has a pole base top support surface including two tracks 24 extending from the pole base front toward the pole shaft 10. These features, as will be described below, allow the front wheels 32 of a rolling weight box 30 to rest on the pole base while keeping the size of the pole base at a minimum. The 45 degree shaft rotation allows the tracks to be placed in a diagonal manner relative to the pole base, offering longer track length and keeping the base size to a minimum.

Figure 5:
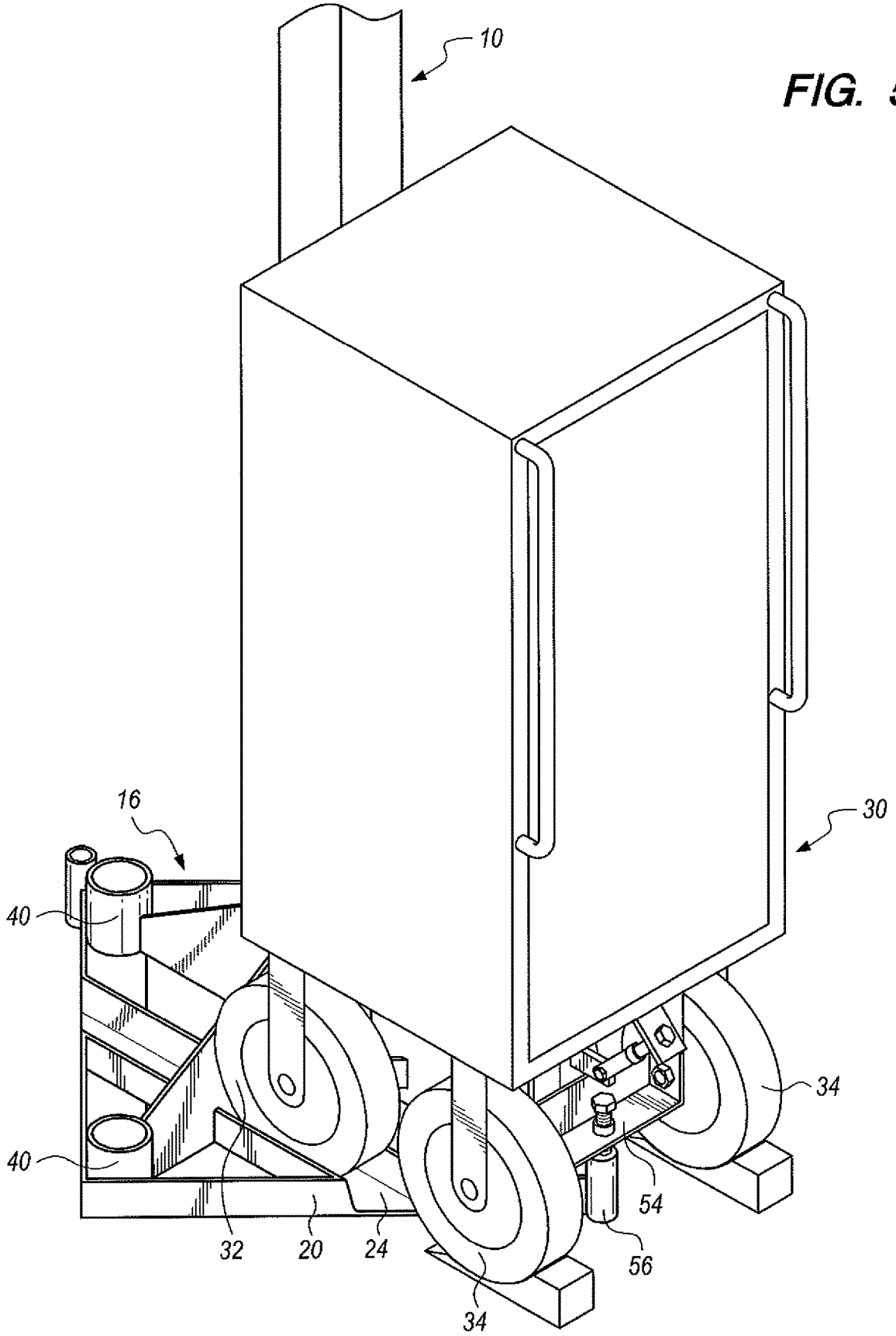
FIG. 5 is a perspective view showing a wheeled rolling weight box in position on the pole base next to the square pole shaft of the elongated pole, only a portion of which is illustrated.
Figure 6:
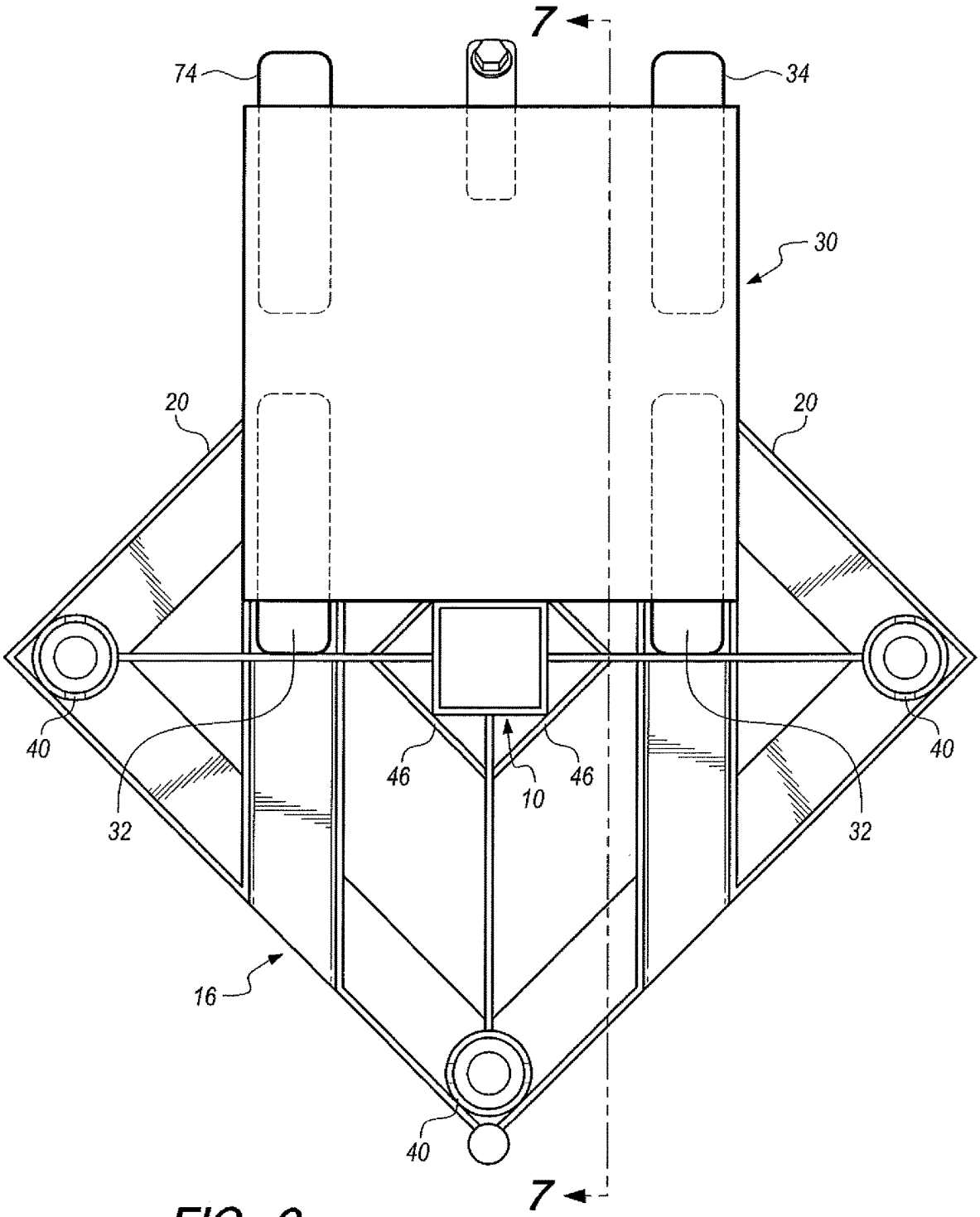
FIG. 6 is an enlarged, top plan view showing the pole base and wheeled rolling weight box in the position shown in FIG. 5.
Figure 7:
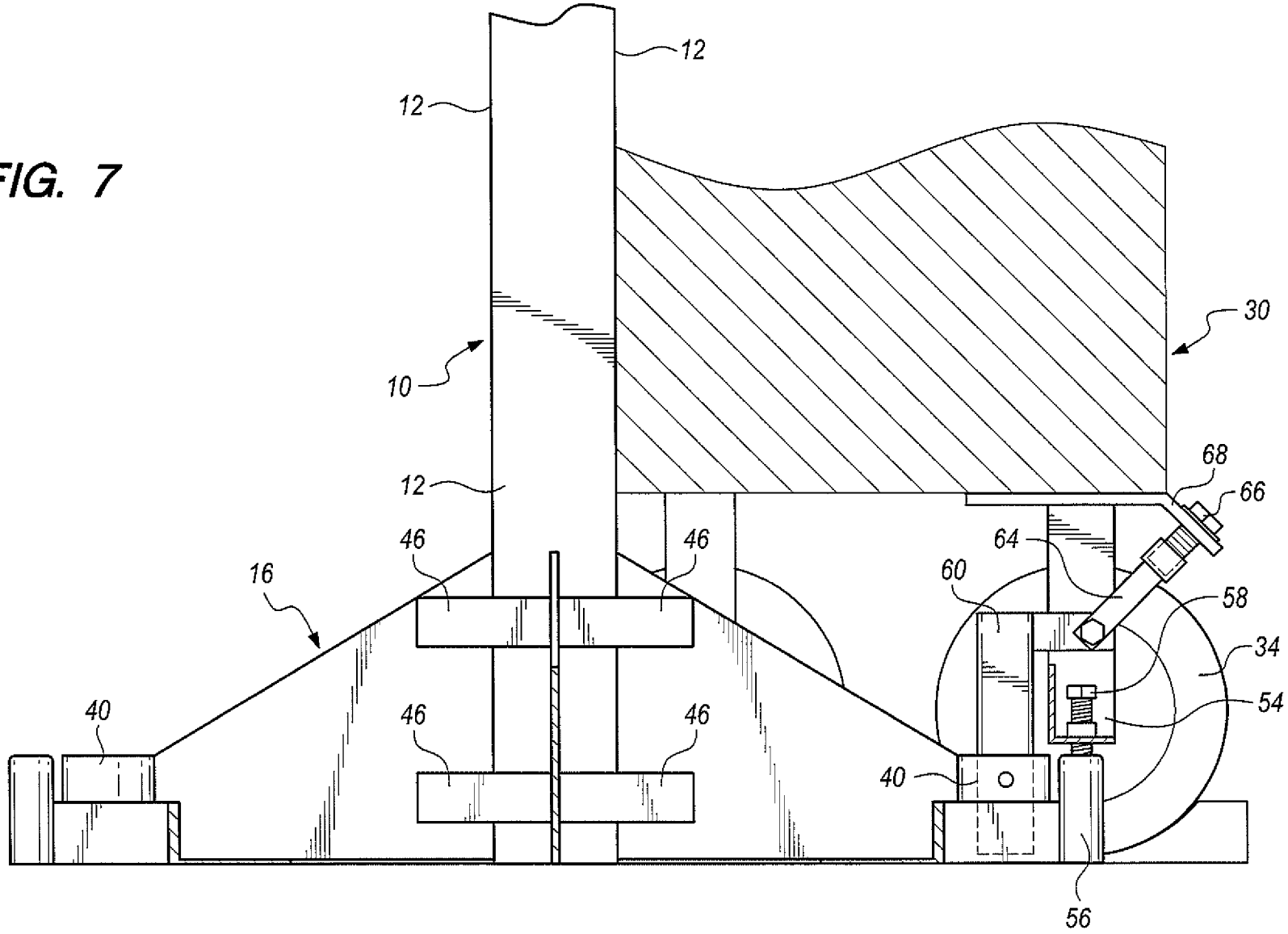
FIG. 7 is a cross-sectional view taken along the line 7-7 in FIG. 6.

FIGS. 5-8 show the wheeled rolling weight box 30 docked to the pole shaft and also show that only the front wheels 32 are on the pole base so that the base size can be kept to a minimum. In this position, base corner 22 is under the weight box. Also visible in FIGS. 5 and 7 are a pair of wheel chocks 38 positioned at the back wheels 34 to keep the box level, as a compensation for the thickness of the tracks that elevated the front wheels.

Although only one pair of tracks 24 is required, in practice two pairs of tracks is preferable as two rolling weight boxes can be added to a pole, greatly reducing the forces on the pole anchor bolts or screws. Alternatively, a thick base plate may be used but it is not structurally efficient as tracks. In fact, however, the rolling weight box approach allows the entire pole to be held down by one or two boxes without the need for any pole anchors, even under high wind load. This provides a huge flexibility with regard to use of shallow anchors and lighter weight boxes. The weight box 30 can carry any form of dead weights or can house heavy batteries for backup power or other equipment, making it a dual-purpose box. The illustrated pole base incorporates four pole base anchor rings 40 which may be employed as desired or necessary.

The pole base 16 has pole base quadrants and upwardly extending gusset webs 44 define the pole base quadrants. The gusset webs are welded or otherwise attached to the pole shaft 10 and two horizontal tie bars 46 bridge between the poles gusset webs at each quadrant of the base. Although these tie bars are not necessarily a must when load is not strong or the wall of the pole is thick, the tie bars significantly enhance the load strength of the pole as the gusset webs are welded to the weak center of the pole walls, not its strong corners due to the 45 degree rotation.

The tracks 24 comprise open topped channels extending from the two base sides 20 forming the pole base corner 22 to the gusset webs. The two tracks are spaced from the square pole shaft and are parallel to each other and two parallel straight pole shaft sides.

As shown in FIG. 1, three holes are formed in the lower part of the pole shaft facing the tracks. The big hole 48 is for cable handling when a rolling weight box also serves as a battery bank. The other two holes 50 are smaller and are threaded holes slightly above and below the big hole for bolting the top part of the rolling weight box to the pole shaft. This feature is one part of the securement structure of the invention for maintaining the front wheels 32 of the wheeled rolling weight box 30 on the pole base closely adjacent to the pole shaft.

Figure 8:
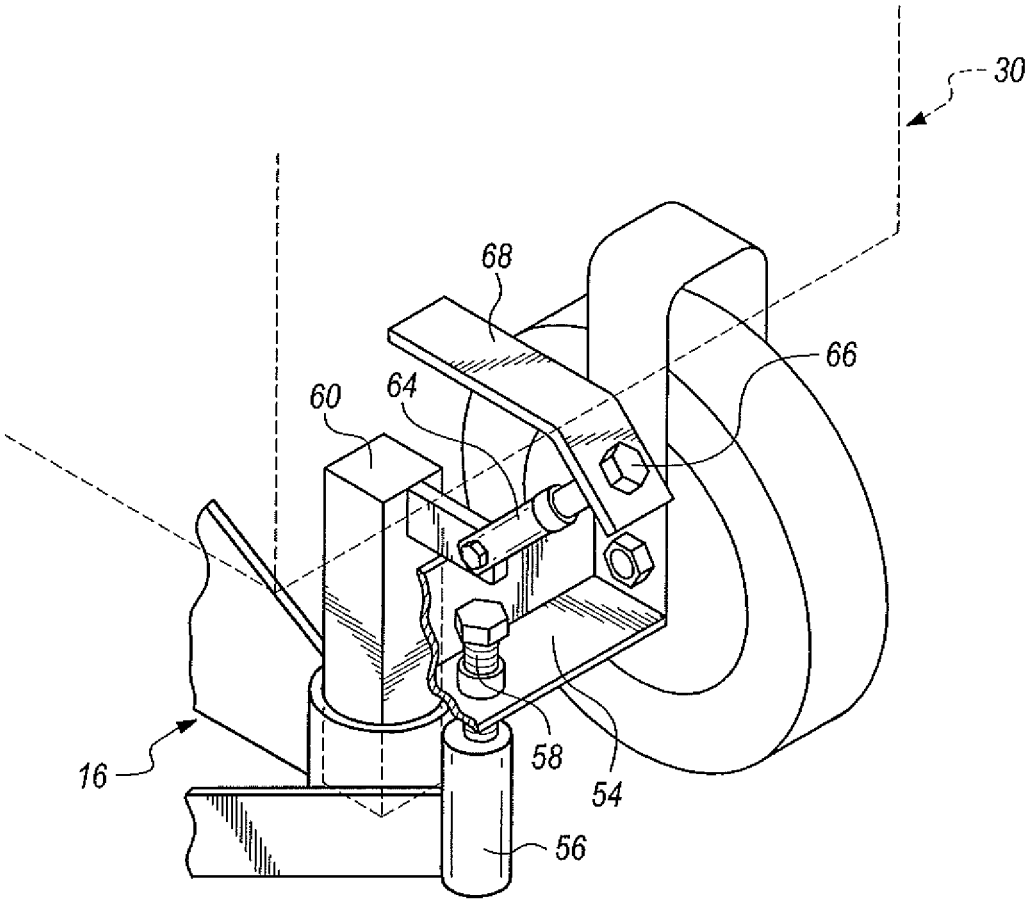
FIG. 8 is a perspective view, greatly enlarged, of a securement structure employed to hold down the wheeled rolling weight box, the latter being indicated by dash lines.

Referring now to the drawings, and in particular FIGS. 5, 7 and 8, the securement structure of the apparatus also has a component, a bridge brace 54, extending between rear wheels 34 of the wheeled rolling weight box. A weight bearing member 56 is secured to the pole base 16 and a load transfer bolt 58 extends therebetween and is attached thereto.

The foundationless pole apparatus includes a hold down adaptor 60 which is positioned in anchor ring 40 at the base corner 22 of the pole base and secured thereto by a lock pin (not shown) passing through the hole in the anchor ring as shown in FIG. 7 and a corresponding hole in the hold-down adaptor. The adaptor is connected by a linkage 64 defining a female thread at the distal end thereof which receives a bolt 66. This arrangement holds down the rolling weight box and pulls the box toward the center of the pole. The hold-down tab 68 at the front of the box is welded to the box bottom similar to the four wheels of the box.

However, the aforementioned box top bolting to the pole and the hold-down assembly at the box bottom are not sufficient to fully integrate the rolling weight box to the pole to make them act as a unit. The bridge brace 54 bolting the two rear wheels 34 together is needed to put the full weight of the box onto the pole base even though these two wheels are actually outside of the base frame. At the center of the bridge brace is the load transfer bolt 58 which puts the weight of the back part of the box directly to the weight bearing member 56 welded to the corner of the base frame next to the anchor ring.

Let's take a closer look at the load paths of an integrated rolling weight box and a small-footprint foundationless pole system to fully illustrate how it works and the clear advantage of the system by examining the wind force applying to the pole system in forward, backward and sideway directions. When wind attempts to overturn the pole towards the weight box, the full weight of the box is exerted through its two front wheels on the tracks and the load transfer bolt to the base frame corner. The two box top bolts keep the box top attached to the pole shaft. The angled hold-down bolt assembly keeps the box from lifting up or moving away from the base of the pole. In addition, the two back wheels through their wheel chocks actually create a longer moment arm resisting the overturning moment, making the system structurally more efficient.

When wind attempts to overturn the pole backwards away from the weight box, the full weight of the box continues to transfer its gravity force through the two front wheels and the load transfer bolt at the bridge brace to the pole base as before. As the overturning pivot point is now at the pole base corner at the opposite end of the weight box, the center of gravity of the weight box gains substantial mechanical advantage against the overturning moment with its increased moment arm from the pivot.

When wind attempts to overturn the pole sideways, the full gravity force of the entire weight box still behaves in the same way as noted before, all transferred to the pole base to resist against the overturning moment. Through the angled hold-down bolt assembly, the two front wheels of the weight box are under compression and fully pressed against the tracks to provide an effective lateral brace, preventing any shifting or movement of the box sideways relative to the pole base.

As shown above, the rolling weight box is innovatively integrated to a foundationless pole in an extraordinary efficient manner as one structurally strong system. The weight box and pole integration increases the footprint area by a small mount, even a touch more if two weight boxes are used. However, its overall size is still just a small fraction of a typical foundationless pole system.

It is worth pointing out additional advantages of the subject invention. The 45 degree rotation of the pole shaft relative to its base is structurally very efficient as a pole's wind drawing payload surface is typically mounted in the same plane as the pole face or orthogonal to it. In a square pole base, its diagonal dimension is 1.414 times longer than its sides. The 45 degree pole shaft rotation increases the moment arm for resisting overturning moment by 41 percent using the same pole base. This greatly reduces the pull-out force on the pole anchors if they are used. Boosted by the 41 percent of moment resisting resistance of the subject invention, there is a tremendous flexibility of using anchors only for light wind load or use the rolling weight box only without anchors as an alternative. Certainly there is always the combination option of using both anchors and weight with lower force values on both. While it is known to utilize square poles disposed at different angles relative to pole bases generally, there is no teaching of the combination of this invention using rotated square poles.

The rolling weight box option not only allows an easy way to add weight to a pole without weight lifting tools, it also offers a flexible way to add easily just the amount of the weight needed for a particular site condition and application. Moreover, by integrating a heavy box with a tall pole as one unit, it becomes very awkward to steal a combined system without heavy equipment even when anchors and anchor ring locks are not used. In a typical application, the rolling weight box has a keyed lock on its door. Once the box is bolted to the pole and its door locked, it becomes difficult to undock the box from its pole. Prior to combining the heavy box and pole together, both items can be moved or handled easily. The rolling weight box can be rolled around, and the small base pole can be carried over a person's shoulder or be wheeled around on a hand truck.

Figure 9:
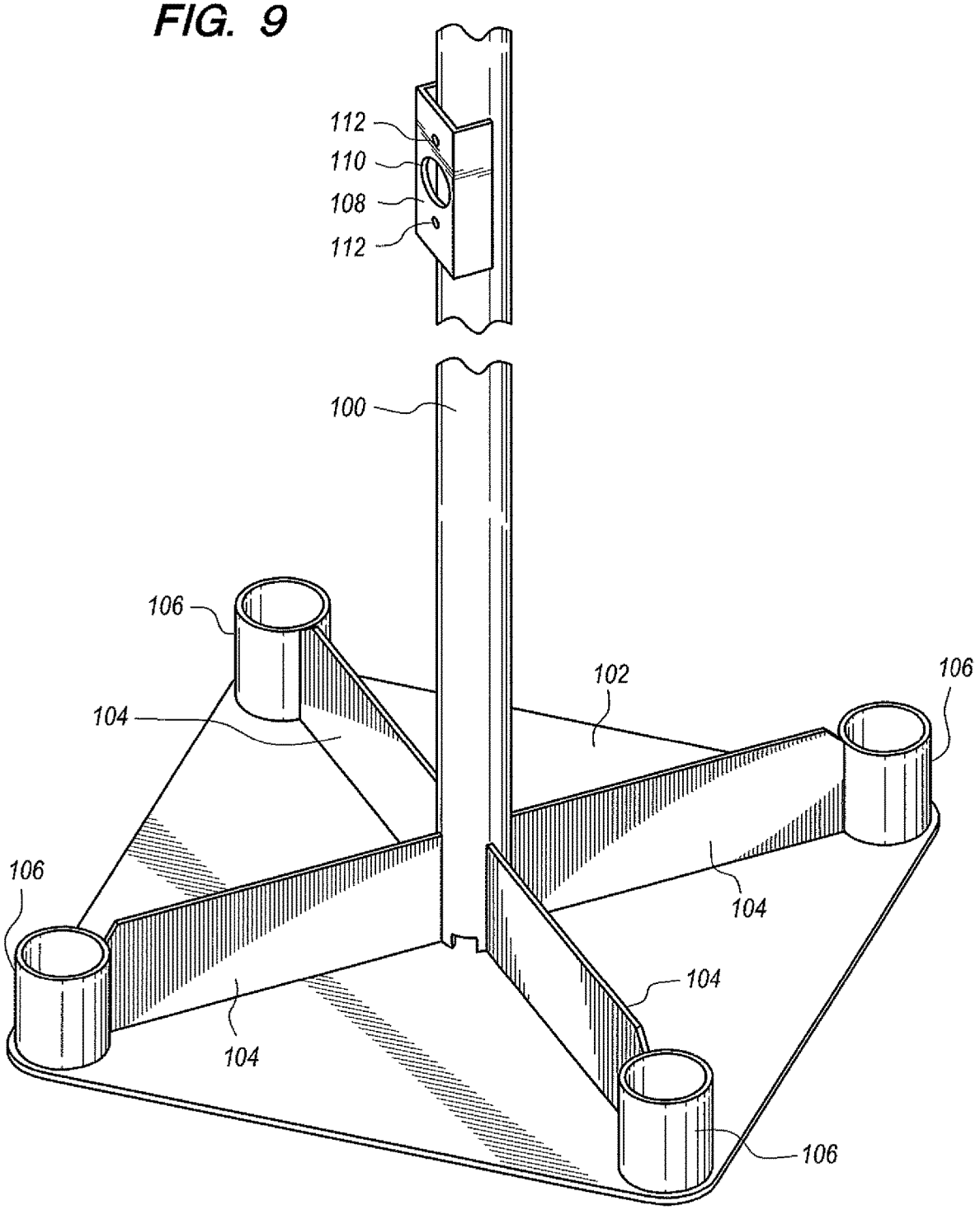
FIG. 9 is a perspective view of an alternative embodiment of the invention.

FIG. 9 shows an alternative embodiment of the foundationless pole apparatus. The foundationless pole apparatus includes an elongated pole having a round pole shaft 100 welded or otherwise secured to a pole base 102 and extending upwardly therefrom. In this embodiment the top support surface is flat over the extent thereof. Four gusset webs 104 are attached to and extend upwardly from the top support surface. The gusset webs extend to the pole and are welded or otherwise affixed thereto. The outermost ends of the gusset webs are fixedly connected to anchor rings 106. In operation, a wheeled rolling weight box, such as wheeled rolling weight box 30 described above with respect to the first embodiment, is positioned with wheels thereof on the top support surface of pole base 102.

In this embodiment, the securement structure is an attachment bracket 108 welded or otherwise affixed to the pole shaft. The bracket has a pole base hole 110 and two smaller holes 112. These holes perform the functions indicated above by holes 48 and 50 with respect to the first invention embodiment; that is, accommodating a cable extending from the rolling weight box and bolting the pole shaft, via the bracket, to the rolling weight box.

This alternative embodiment is particularly applicable to smaller pole apparatus and light wind loading conditions.

If desired, two brackets may be used, the brackets being attached in opposition to one another on opposite pole sides.

The invention claimed is:

1. Foundationless pole apparatus comprising in combination:

an elongated pole having a substantially square pole shaft having four interconnected straight pole sides;

a pole base connected to said pole shaft and having pole base sides including a substantially straight pole base side spaced from said pole shaft and a pole base top support surface extending from said substantially straight pole base side toward said pole shaft;

a wheeled rolling weight box having wheels positionable on said pole base top support surface; and a securement structure operatively associated with said pole shaft, said pole base and said wheeled rolling weight box, said securement structure securing said wheeled rolling weight box to said pole base and to said pole shaft with at least some of the wheels of said wheeled rolling weight box on said pole base top support surface and secured adjacent to said pole shaft, said pole base attached to and supporting said pole shaft and two of the pole base sides disposed at right angles to one another and forming a pole base corner, said square pole shaft oriented with the straight pole shaft sides thereof disposed at substantially 45 degree angles relative to said substantially straight pole base sides, said pole base including at least two tracks extending from said pole base corner toward said pole shaft, said pole base being substantially square and having pole base quadrants and upwardly extending gusset webs defining said pole base quadrants attached to said pole shaft, said at least two tracks comprising open topped channels extending from the two pole base sides forming the pole base corner to said gusset webs, said at least two tracks receiving wheels of said rolling weight box and spaced from said pole shaft and parallel to each other and to two parallel straight pole shaft sides.

2. The foundationless pole apparatus according to claim 1 including a tie bar extending between each pair of adjacent gusset webs.

3. The foundationless pole apparatus according to claim 1 wherein said securement structure includes a bridge brace extending between wheels of said wheeled rolling weight box, a weight bearing member secured to said pole base and a load transfer bolt extending therebetween and attached to said bridge base and said weight bearing member.

4. The foundationless pole apparatus according to claim 1 wherein said securement structure includes at least one attachment bracket attached to said pole shaft and secured to said wheeled rolling weight box.

5. The foundationless pole apparatus according to claim 4 wherein said at least one attachment bracket and said pole shaft define aligned holes for receiving a bolt or other fastener.

6. The foundationless pole apparatus according to claim 1 wherein said securement structure includes a box hold-down adaptor connectable to said pole base and to said wheeled rolling weight box.

7. The foundationless pole apparatus according to claim 6 wherein said pole base includes a pole base anchor ring and wherein said box hold-down adaptor is positioned in and connected to said anchor ring.

8. The foundationless pole apparatus according to claim 1 wherein said securement structure is operable to resist tilting due to wind impact on the elongated pole in forward, backward and sideway directions.

* * * * *